United States Patent [19]

Bolle, Jr. et al.

[11] Patent Number: 4,743,006

[45] Date of Patent: May 10, 1988

[54] FANNER MAGNET ASSEMBLY

[75] Inventors: Fred Bolle, Jr., Milford; John R. Herronen, Linden; Joseph M. Wright, Fenton, all of Mich.

[73] Assignee: Tek-Matik, Inc., Hartland, Mich.

[21] Appl. No.: 165

[22] Filed: Mar. 18, 1987

[51] Int. Cl.[4] ..... B65H 3/16

[52] U.S. Cl. ..... 271/18.1; 271/105

[58] Field of Search ..... 271/18.1, 193, 145; 414/35, 122; 271/105

[56] References Cited

U.S. PATENT DOCUMENTS 2,860,874 11/1958 Gulick ..... 271/18.1 X 3,998,448 12/1976 Gray ..... 271/18.1 X

*Primary Examiner*—Richard A. Schacher

*Attorney, Agent, or Firm*—Krass & Young

[57] ABSTRACT

A fanner magnet assembly including a power actuated carriage and a magnet assembly mounted on the carriage for lost motion relative to the carriage and for pivotal movement relative to the carriage. The magnet assembly is moved forwardly into engagement with a side face of the associated stack of metal sheets, whereafter the forward movement of the carriage is continued as allowed by the lost motion connection between the magnet assembly and the carriage to a predetermined initial position, whereafter proximity switches function to withdraw the carriage relative to the magnet assembly to an operative position in which the desired amount of side loading is applied to the stack. As misaligned sheets are encountered in the stack as the stack is moved incrementally upwardly, a beveled face at the bottom of the magnet is cammed rearwardly to accommodate the misaligned sheets or, in the event of grossly misaligned sheets, the misaligned sheets engage the undersurface of the magnet and pivot the magnet assembly upwardly to generate a signal to totally withdraw the magnet assembly from the side face of the stack whereafter the assembly is again advanced to establish the desired loading against the side face of the stack.

8 Claims, 3 Drawing Sheets

FANNER MAGNET ASSEMBLY

BACKGROUND OF THE INVENTION

This invention relates to fanner magnet assemblies.

Fanner magnets are used to fan out or separate the sheets in a stack of metal sheets so that the sheets may be picked up by suitable transfer devices such as suction cups for movement to another location where the sheets may be processed by suitable processing equipment. The magnets operate on the principle of disparate polarity along the vertical face of a magnet so that the individual metal sheet adjacent the top of the stack are fanned out or separated to facilitate the operation of the transfer device.

Typically, a plurality of magnets are arrayed along one side edge of the stack of sheets adjacent the top of the stack and a like plurality of magnets are arrayed along the opposite side edge of the stack of sheets adjacent the top of the stack. Typically, a stack of metal sheets is raised into position between the opposed fanner magnets, and the fanner magnets are moved into engagement with the opposite side faces of the stack adjacent the top of the stack to fan out the sheets adjacent the top of the stack to facilitate the transfer operation. As the stack is depleted, the stack is moved upwardly in incremental amounts with the fanner magnets continuing to engage the top portion of the stack as the stack is moved incrementally upwardly.

Whereas fanner magnets of this general type have proven to be generally satisfactory in facilitating the transfer operation, the prior art magnet assemblies have typically generated an error signal in the event that transversely misaligned sheets occur in the stack and the error signal has typically been utilized to withdraw all of the magnet assemblies in a ganged manner from the stack and reject the stack. After the stack has been rejected and a new stack moved upwardly in its place, the fanner magnets are again moved in gang fashion into engagement with the opposite side faces of the new stack, and the fanning and transfer operations continue. This ganged withdrawal of all of the magnet assemblies in response to an error signal and replacement of the stack is both wasteful and time consuming.

SUMMARY OF THE INVENTION

This invention is directed to the provision of a fanner magnet assembly that operates selectively to accommodate misaligned sheets in the associated stack of sheets without aborting the operation of the fanner magnet or the operation of related fanner magnet assemblies also engaging the stack assembly and without rejecting the stack in the event that misaligned sheets are encountered.

The invention fanner magnet assembly includes a frame structure adapted to be positioned at one side of the stack of sheets and defining an elongate guideway extending transversely toward one side face of the stack of sheets; a carriage mounted for forward and rearward movement along the guideway respectively toward and away from the stack side face; a magnet assembly mounted on the forward end of the carriage and including a magnet having a leading vertical face adapted to be moved into engagement with the side face of the stack in response to forward movement of the carriage along the guideway toward the stack; and lost motion means, including a spring interposed between the carriage and the magnet assembly, allowing the magnet assembly to move rearwardly relative to the carriage against the bias of the spring. The magnet assembly further includes power and control means operative to move the carriage forwardly along the guideway to move the magnet assembly forwardly and move the magnet face into engagement with the side face of the sheet stack and thereafter, with continued forward movement of the carriage, to move the magnet assembly rearwardly relative to the carriage against the bias of the lost motion spring. The power and control means are further operative, in response to movement of the magnet assembly a first predetermined distance rearwardly relative to the carriage to an initial relative position of the carriage and magnet assembly, to stop the forward movement of the carriage and move the carriage rearwardly relative to the magnet assembly a second predetermined distance, to an operative relative predetermined distance, to an operative relative position while the magnet face is maintained in engagement with the stack side face by the lost motion spring. This arrangement allows a predetermined amount of force to be automatically applied to the side faces of the stack as the magnet assemblies are moved into engagement with the side face of the stack and allows the magnet assembly to move rearwardly relative to the carriage to accommodate misaligned sheets in the stack without generating an error signal.

According to a further feature of the invention, the power and control means comprises a motor engaging the rearward end of the carriage and control means for energizing the motor and including limit switch means sensing the arrival of the magnet assembly at its initial position relative to the carriage. This arrangement provides a signal to the motor to discontinue the forward movement of the carriage and begin its rearward movement to its operative position relative to the magnet assembly in which the predetermined force is applied against the side face of the magnet.

According to a further feature of the invention, the magnet assembly is also mounted for pivotal movement relative to the carriage about a horizontal axis spaced rearwardly from the leading face of the magnet and the magnet presents a generally horizontal undersurface extending rearwardly from the lower end of the leading face. With this arrangement, as the stack is raised in response to stack depletion any grossly transversely misaligned sheets in the stack will engage the undersurface of the magnet and pivot the magnet assembly upwardly about the horizontal axis to generate an error signal which is utilized to move the carriage and thereby the magnet assembly rearwardly along the guideway to a rest position in which the magnet is totally withdrawn from the side face of the stack. This arrangement allows the individual magnet assemblies to be totally withdraw in response to encountering grossly misaligned sheets in the stack without disturbing the operation of the remaining magnet assembly.

According to a further feature of the invention, the power and control means are further operative, following movement of the carriage to its withdrawn rest position, to again move the carriage and magnet assembly forwardly to engage the face of the magnet with the misaligned sheets and allow the magnet assembly and carriage assembly to move first to their initial relative position and thereafter to their operative relative positions so that the withdrawn magnet assembly is thereby quickly and automatically restored to its operative position in which it maintains the desired amount of side loading against the stack.

According to a further feature of the invention, the magnet further includes a beveled surface extending downwardly and rearwardly away from the lower end of the leading face of the magnet so that misaligned sheets in the stack that project transversely from the side face of the stack by a distance less than the rearward extend of the beveled surface will engage the beveled surface as the stack is raised in response to stack depletion and cammingly move the magnet assembly rearwardly relative to the carriage against the bias of the lost motion spring by a distance corresponding to the transverse projection of the misaligned sheets. As the cumulative camming rearward movement of the magnet assembly by the misaligned sheets moves the magnet assembly to its initial position relative to the carriage, the power and control means again operate to move the carriage rearwardly through the second predetermined distance to its operative position relative to the magnet assembly while the magnet face is maintained in engagement with the stack side face by the lost motion spring. The magnet assembly thus functions to accommodate minor sheet misalignments in the stack without disturbing the fanning operation of the assembly and thereafter, once the cumulative adjustments occurring in response to successively encountered misaligned sheets reaches a predetermined value, the assembly readjusts itself to restore the desired amount of side loading force to the stack.

According to a further feature of the invention, the carriage defines a lost motion guideway adjacent its forward end; the magnet assembly further includes a block member mounted in the lost motion guideway for forward and rearward movement relative to the carriage; the lost motion spring extends between the carriage and the rearward end of the block member; the magnet assembly further includes a magnet support frame pivoted at its rearward end to the block member for movement about a generally horizontal axis; and the magnet is carried on the forward end of the magnet support frame. This simple and inexpensive construction provides the desired lost motion as between the magnet assembly and the carriage as well as the desired upward pivotal capability of the magnet assembly relative to the carriage.

In the disclosed embodiment of the invention, the magnet support frame includes a rearward bifurcated portion including horizontally spaced arm portions embracing opposite sides of the block member; the magnet support frame is pivoted to the block member by a pivot pin passing through the arm portions and through the block member; the magnet support frame further includes a forward bifurcated portion including vertically spaced arm portions; and the magnet is mounted vertically between the vertically spaced arm portions and is pivoted relative to the support frame about a generally vertical axis passing through the vertically spaced arm portions. This arrangement allows the desired lost motion and upward pivotal connections as between the carriage and the magnet assembly and additionally allows the magnet to pivot about a vertical axis to accommodate a curvilinear contour in the side face of the stack of sheets.

DETAILED DESCRIPTION OF THE PREFERRED EMBODIMENT

Figure 1:
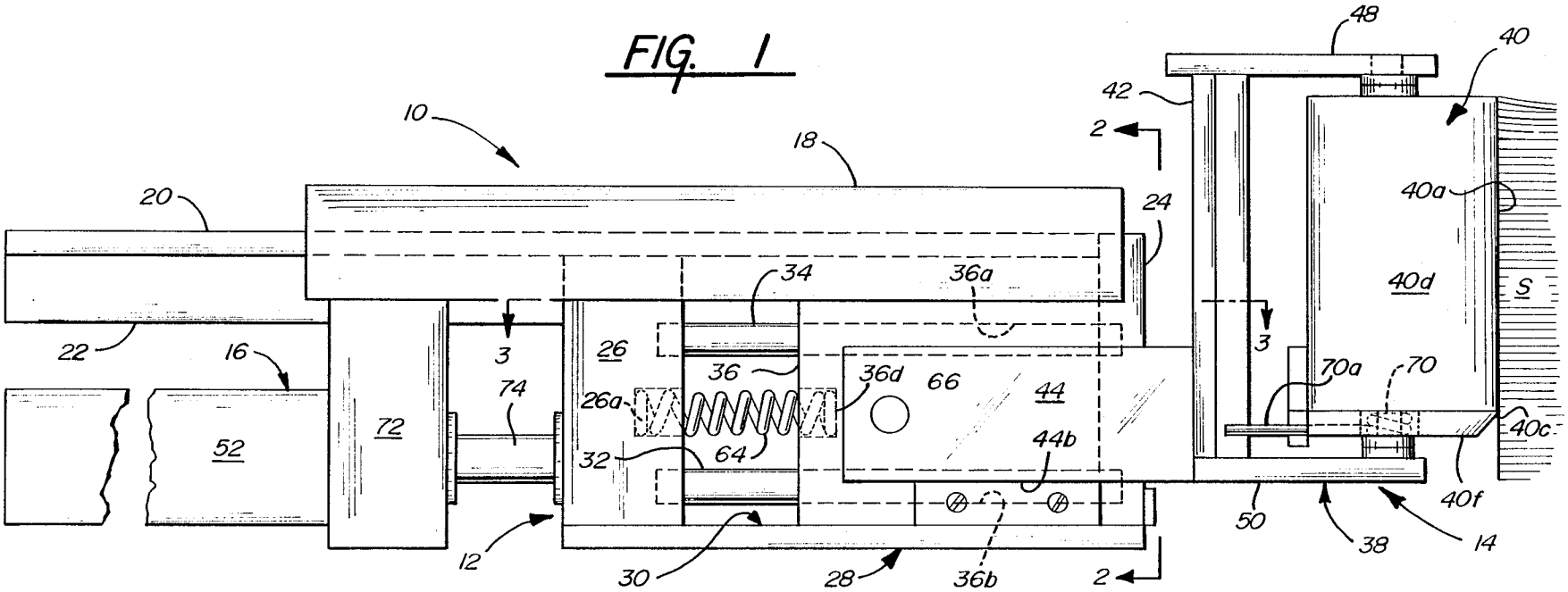
FIG. 1 is a somewhat schematic side elevational view of the invention fanner magnet assembly.
Figure 2:
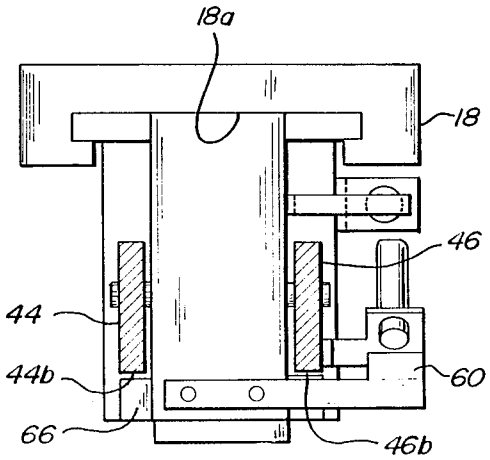
FIGS. 2 and 3 are cross-sectional views taken respectively on lines 2—2 and 3—3 of FIG. 1.
Figure 3:
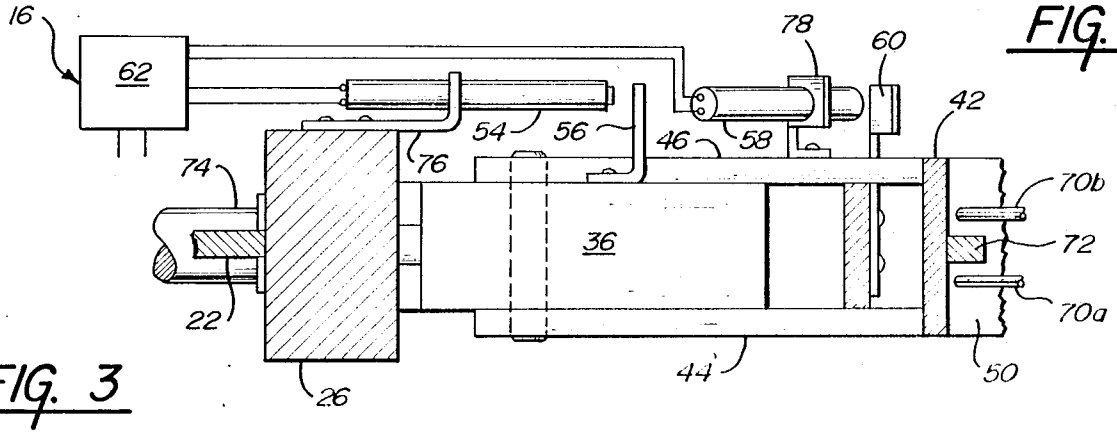

The invention fanner magnet assembly includes a frame structure 10, a carriage 12, a magnet assembly 14, and power and control means 16.

Frame structure 10 includes an elongate frame member 12 adapted to be securedly positioned at one side of a stack S of metal sheets to be fanned and defining an elongate T-shaped guideway 12*a* extending transversely toward one side face of the stack of sheets S. Frame member 12 may, for example, be suitably fixedly secured to an overhead support structure.

Carriage 12 includes a slide plate 20 slidably received in guideway 12*a;* a vertical strongback 22 centrally secured to the underface of slide plate 20; a forward mounting plate 24 extending downwardly from the forward end of slide plate 20; a mounting block 26 extending downwardly from mounting plate 20 at a location spaced rearwardly from mounting plate 24; a bottom plate 28 extending between the lower ends of mounting plate 24 and mounting block 26 and coacting with mounting plate 24 and mounting block 26 to define a lost motion guideway 30 at the forward end of the carriage; and a pair of vertically spaced horizontally extending guide shafts 32 and 34 extending between the lower ends of mounting block 26 and mounting plate 24.

Magnet assembly 14 includes a block member 36 slidably mounted in guideway 30; a magnet support frame 38; and a magnet 40.

Block member 36 is rectangular in cross section and includes vertically spaced, horizontally extending throughbores 36*a* and 36*b* respectively slidably receiving guide shafts 32 and 34; a transverse throughbore 36*c;* and a blind bore 36*d* in its rear face positioned centrally between guidebores 36*a* and 36*b*.

Magnet support frame 38 includes a vertical plate member 42; a pair of laterally spaced arm members 44 and 46 extending rearwardly from the lower end portion of plate member 42; and a pair of vertically spaced arm members 48 and 50 extending forwardly from the upper and lower edges respectively of plate member 42.

Magnet 40 is a fanner magnet of known construction providing disparate polarity along the leading vertical face 40*a* of the magnet so that individual metal sheets in the sheet stack S are fanned out or separated adjacent the top of the stack to facilitate gripping by a suitable transfer device for movement of the sheet to a remote location for further processing. Magnets of this general type are available, for example, from Bunting Magnetics of Newton, Kan. as Part No. BSK4146. The invention fanner magnet is customized to provide rounded, forward, vertical edges 40*b* at each side of face 40*a* and a beveled edge 40*c* at the lower end of the magnet extending downwardly and rearwardly from face 40*a* at an angle of approximately 45 degrees. Beveled edge 40*c* also extends along the lower edge of magnet side faces 40*d* and 40*e*.

Power and control means 16 includes a hydraulic cylinder 52 of known construction; a first proximity switch 54 coacting with a flag 56; a second proximity switch 58 coacting with a flag 60; and a control unit 62.

In the assembled relation of the various parts of the invention magnet assembly, frame member 18 is suitably secured to adjacent support structure to provide an overhead support for the carriage 12; slide plate 20 of carriage 12 is slidably received in guideway 18*a;* guide block 36 is slidably received in lost motion guideway 30 with guide shafts 32,34 passing slidably through bores 36*a*,36*b* and with a lost motion coil spring 64 positioned at its forward end in blind bore 36*d* of block member 36 and at its rearward end in a blind bore 26*a* in the forward face of mounting block 26 and acting to urge the forward face of block member 36 into engagement with the rearward face of plate member 24; arm members 44 and 46 of magnet support frame 38 embrace block member 36 and are pivotally secured at their rearward ends to block member 36 by a pivot shaft 66 passing successively through bores 44*a*, 36*c*, and 46*a*; the lower horizontal edges 44*b* and 46*b* of arm members 44 and 46 rest on the upper edges of arm rest members 66 secured to the lower opposite side faces of block member 36 to define the lowered position of the arm members; magnet 40 is positioned vertically between arm members 48 and 50 by a vertical pivot pin 68 passing downwardly through aligned apertures in arm member 48, magnet 40 and arm member 50; a coil spring 70 is positioned in a recess in the lower end of magnet 40 in surrounding relation to shaft 68 with its opposite arm end portions 70*a* and 70*b* embracing a rib member 72 secured to the forward face of vertical plate 42 to provide spring biased resistance to movement of magnet 40 about its vertical axis in either direction; hydraulic cylinder 52 is secured to and extends rearwardly from a bracket member 72 extending downwardly from frame member 18 with the piston rod 74 of the cylinder suitably secured to the rear face of mounting block 26; proximity switch 54 is secured to a side face of mounting block 26 in a horizontally extending position by a mounting bracket 76; flag 56 is secured to the associated side face of block member 36; proximity switch 58 is secured to a side face of arm member 46 in a downwardly and forwardly angled position by a bracket 78; and flag member 60 is secured to the forward lower end of mounting plate 24 and extends laterally into confronting relation with the forward lower end of proximity switch 58. Whereas guide shafts 32 and 34 are shown for simplicity as directly engaging bores 36*a* and 36*b* of block member 36, in actual practice a ball bush bearing of the type utilizing recirculating balls would preferably be interposed between the guide shafts and the bores of the block member to minimize the linear friction as the magnet assembly is moved linearly in the lost motion guideway relative to the carriage. A suitable ball bushing bearing is available, for example, from Thompson Industries, Inc. of Manhasset, N.Y. as Part No. Super-12.

Figure 5:
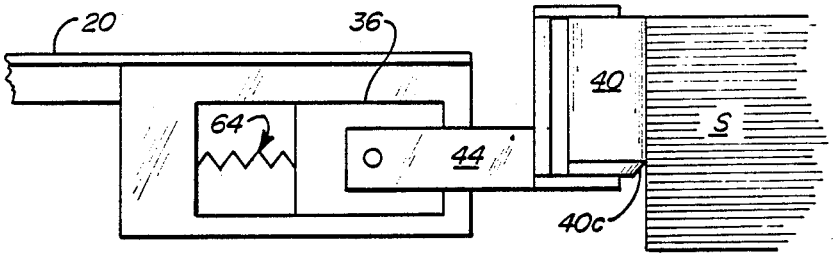
FIGS. 5–9 are schematic side elevational views showing various steps in the operation of the invention fanner magnet assembly.
Figure 6:
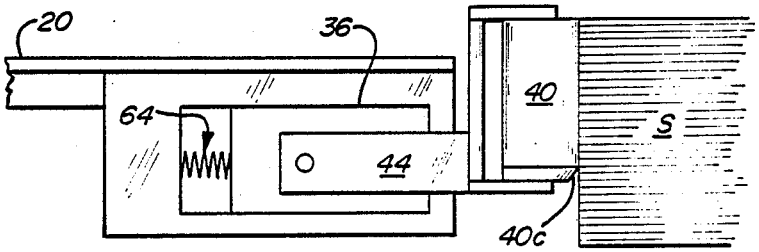
Figure 7:
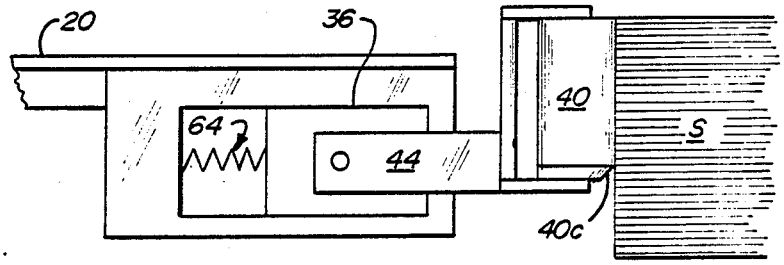
Figure 10:
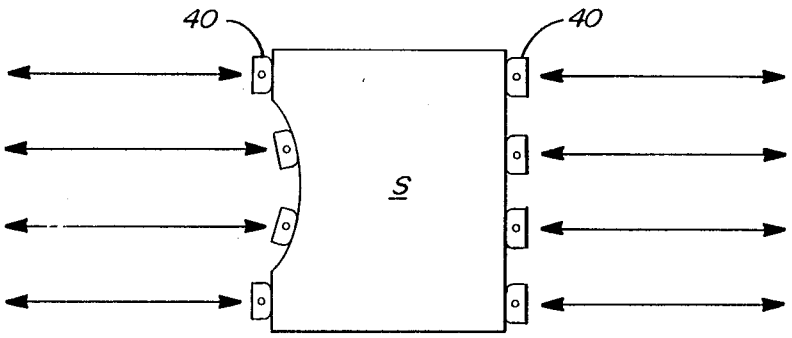
FIG. 10 is a diagrammatic view showing the combined operation of a plurality of invention fanner magnet assemblies.
Figure 4:
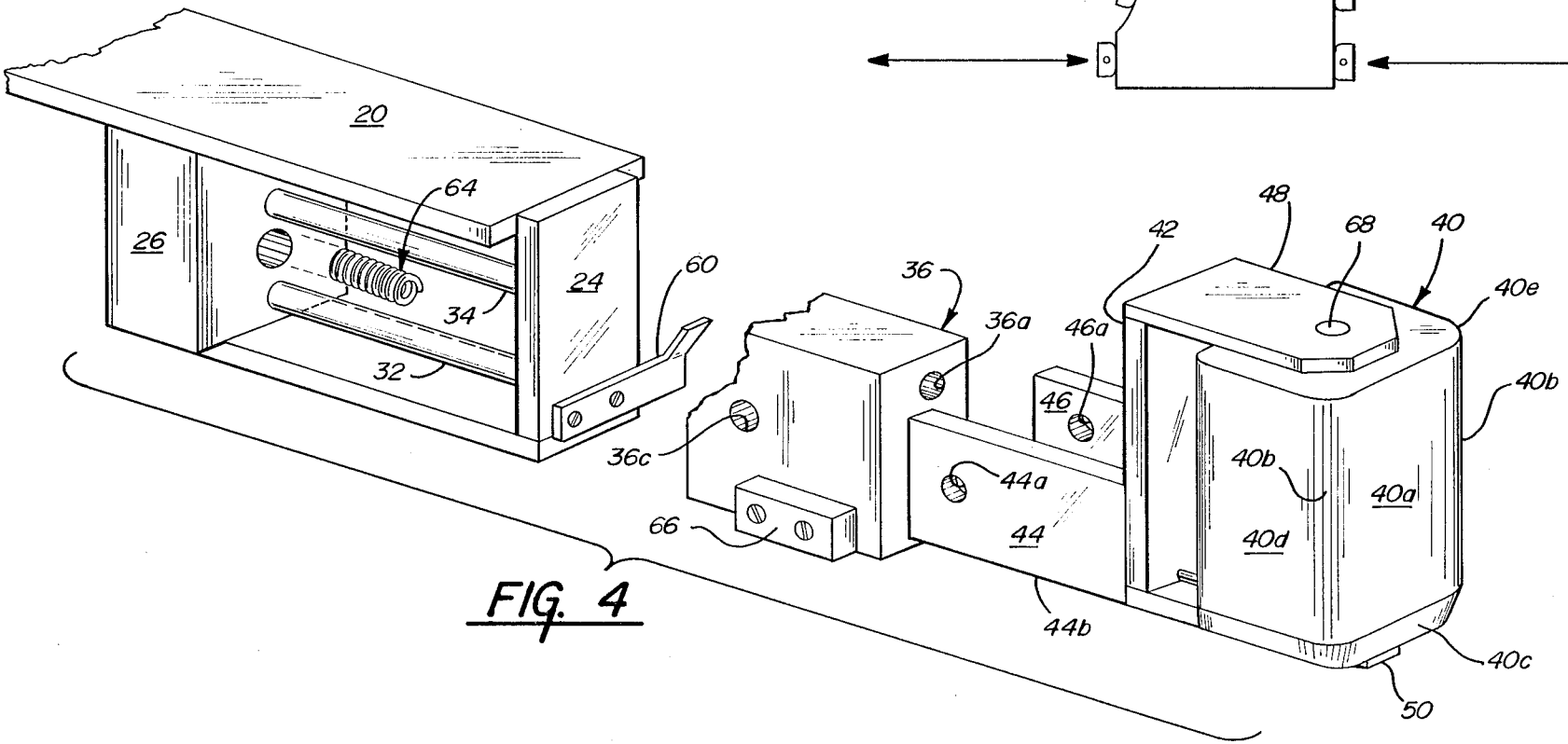
FIG. 4 is an exploded fragmentary view showing a subassembly of the invention fanner magnet assembly.

It will be understood that the invention fanner magnet assemblies are used in a combination of assemblies with a first series of assemblies adapted to engage one side face of the stack S and a second series of assemblies adapted to engage the opposite side face of the stack S. Such an arrangement is shown schematically in FIG. 10. In operation, the motors 52 controlling the individual magnets 40 are simultaneously actuated to move the various assemblies forwardly until the forward faces 40*a* of the magnets engage the respective side faces of the stack S. In the case of sheets of the type seen in FIG. 10 wherein one side edge of the sheet includes a cutout portion, the magnets engaging the cutout portion proceed forward further than the other magnets and pivot about their shafts 68 to accommodate the contour of the engaged sheets. With respect to each magnet assembly, after the leading face 40*a* of the magnet has moved into engagement with the side edge of the stack (see FIG. 5) the motor continues to move the carriage forwardly with the forward motion now being accommodated by the lost motion connection between the magnet assembly and the carriage assembly. Specifically, as the carriage continues to move forwardly after the leading face of the magnet has engaged the side edge of the stack S, block member 36 moves rearwardly in lost motion guideway 30 against the bias of lost motion spring 64. After the magnet assembly has moved a first predetermined distance rearwardly relative to the carriage (for example, one inch) to an initial or preliminary relative position of the carriage and magnet assembly as seen in FIG. 6, flag 56 on block member 36 is moved into proximate relation to the free end of proximity switch 54 to generate a signal which is transmitted to control unit 62 and thence to motor 52 to stop the motor and terminate the forward movement of the carriage and thereafter instantaneously reverse the motor to move the carriage rearwardly relative to the magnet assembly a second predetermined distance less than the first predetermined distance (for example, $\frac{3}{4}$ of an inch) to an operative relative position of the carriage and magnet assembly, as seen in FIG. 7, with the lost motion spring 64 functioning to maintain the leading magnet face 48 in engagement with the stacked side face as the carriage retreats to its operative position. It will be understood that this procedure operates to establish a predetermined force acting against the side of the stack to optimize the operation of the fanner magnet without buckling the sheets in a manner that would derogate the operation of the transfer mechanism. Specifically, the various parameters may be chosen such that, with the carriage and magnet assembly in their initial or preliminary position of FIG. 6, the spring operates to impose a 40 lb. load against the side of the stack whereas, after the parts have retreated to their operative position of FIG. 7, the spring has been unloaded to an extent such that it operates to apply a force of approximately 10 lbs. to the side face of the stack so as to optimize the operation of the fanner magnet without buckling the sheets to an extent to interfere with the operation of the transfer mechanism. The control unit may, for example, include a timer unit that times out the rearward movement of the carriage relative to the magnet assembly so that the rearward movement of the carriage is automatically halted after the lapse of a predetermined period of time corresponding to a predetermined distance of rearward movement of the carriage relative to the magnet assembly to establish the operative position of FIG. 7.

If the stack S is uniform for the entire height of the stack, the magnet assemblies will make no further adjustment as the stack is incrementally moved upwardly (for example, in 2 inch increments) in response to depletion of the stack. If, however, misaligned sheets are encountered in the stack as the stack is moved incrementally upwardly, the invention magnet assembly operates to effectively and automatically accommodate these sheets without aborting the overall operation of the fanner magnets and without rejecting the stack.

Figure 8:
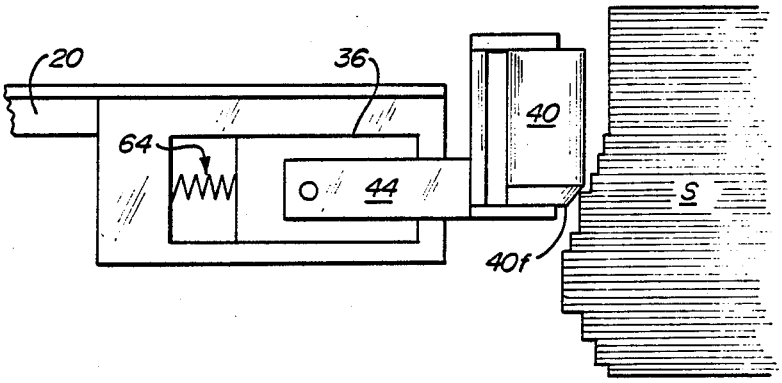
Figure 9:
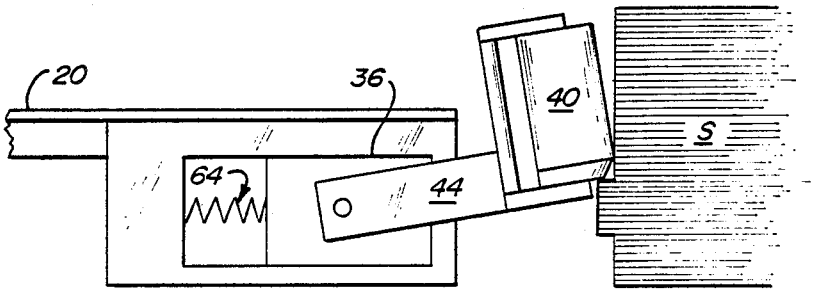

Specifically, as the magnet encounters misaligned sheets in the stack as the stack is moved incrementally upwardly, the magnet will either move incrementally rearwardly as seen in FIG. 8 or pivot upwardly as seen in FIG. 9 with the specific movement being determined by the extent of misalignment of the sheets.

With specific reference to FIG. 8, if the extent of misalignment is less than the rearward extent of magnet beveled surface 40*c*, the magnet assembly will be moved cammingly rearwardly relative to the carriage against the bias of spring 64 to incrementally increase the load applied to the side of the stack by spring 64. As the magnet assembly is moved incrementally rearwardly in response to cumulative rearward camming occurring in response to successive incremental upward movements of the stack, the magnet assembly will ultimately reach the operative relative position of FIG. 6 at which point flag 56 has again moved into proximate relation to proximity switch 54 so that a signal is transmitted to control unit 62 and from control unit 62 to motor 52 to move the carriage rearwardly relative to the magnet assembly to the position of FIG. 7 to reestablish the desired 10 1b. preload against the side of the stack.

If, however, the misaligned sheets encountered as the stack is moved incrementally upwardly are misaligned by an extent exceeding the rearward extent of beveled surface 40*c*, the misaligned sheets, as seen in FIG. 9, will engage the undersurface 40*f* of the magnet and pivot the magnet assembly upwardly about the axis of pivot shaft 66. As soon as the magnet assembly has pivoted upwardly by a predetermined angular distance (for example 15 degrees), proximity switch 58 is moved out of proximate relation to flag 60 so as to break the circuit established by proximity switch 58. Control unit 62 operates in response to such circuit breakage to actuate cylinder 52 in a sense to withdraw the carriage and magnet assembly to a rest position in which the magnet is totally withdrawn from the side face of the stack, whereafter the control unit functions to reverse the movement of the cylinder 52 and again move the magnet assembly forwardly to the position of FIG. 5 to reestablish contact of leading face 40*a* with the side edge of the stack, thereafter move the magnet assembly to the initial position of FIG. 6, and thereafter withdraw of the carriage to the operative relative position of FIG. 7 to reestablish the desired 10 lb. loading against the side face of the stack.

The overall control circuitry for the several magnet assemblies is such that each magnet assembly is controlled individually so that each magnet assembly may move forwardly and rearwardly relative to the associated side face of the stack without influencing the engagement of the remaining magnet assemblies with the side face of the stack. Specifically, one or more of the magnet assemblies engaging the left side of the stack, as viewed in FIG. 10, may undergo the camming readjustment as seen in FIG. 8, or the total withdrawal adjustment as seen in FIG. 9, without affecting the operation of the remaining magnet assemblies on that side of the stack and without affecting the magnet assemblies on the opposite side of the stack. In this way, the invention magnet assemblies operate to accommodate misaligned sheets in the stack without affecting the other magnet assemblies and without generating a reject signal requiring the rejection of the entire stack, and further operate continuously to maintain substantially the desired loading against the stack at each magnet assembly so as to optimize the operation of the fanner magnets and avoid buckling of the sheets in a manner that would interfere with the operation of the associated transfer devices.

Whereas a preferred embodiment of the invention has been illustrated and described in detail, it will be apparent that various changes may be made in the disclosed embodiment without departing from the scope or spirit of the invention.

We claim:

1. A fanner magnet assembly for fanning stacked metal sheets, said assembly comprising:

(A) a frame structure adapted to be positioned at one side of a stack of metal sheets and defining an elongate guideway extending transversely toward one side face of the stack of sheets;

(B) a carriage mounted for forward and rearward movement along said guideway respectively toward and away from the stack side face;

(C) a magnet assembly mounted on the forward end of said carriage and including a magnet having a leading vertical face adapted to be moved into engagement with the stack side face in response to forward movement of said carriage along said guideway toward the stack;

(D) lost motion means, including a spring interposed between said carriage and said magnet assembly, allowing said magnet assembly to move rearwardly relative to said carriage against the bias of said spring; and (E) power and control means operative (1) to move said carriage forwardly along said guideway to move said magnet assembly forwardly and move said magnet face into engagement with the stack side face and thereafter, with continued forward movement of said carriage, to move said magnet assembly rearwardly relative to said carriage against the bias of said lost motion spring, and (2) thereafter in response to movement of said magnet assembly a first predetermined distance rearwardly relative to said carriage to an initial relative position of said carriage and magnet assembly, to stop the forward movement of said carriage and move said carriage rearwardly relative to said magnet assembly a second predetermined distance, less than said first predetermined distance, to an operative relative position while said magnet face is maintained in engagement with the stack side face by said lost motion spring.

2. A magnet assembly according to claim 1 wherein said power and control means comprises:

(F) a motor engaging the rearward end of said carriage; and (G) control means for energizing said motor and including limit switch means sensing the arrival of said magnet assembly at said initial position relative to said carriage.

3. A magnet assembly according to claim 1 wherein:

(F) said magnet assembly is also mounted for pivotal movement relative to said carriage about a horizontal axis spaced rearwardly from said leading magnet face and said magnet presents a generally horizontal undersurface extending rearwardly from the lower end of said leading magnet face so that, as the stack is raised in response to stack depletion, any grossly transversely misaligned sheets in the stack will engage said undersurface of said magnet and pivot said magnet assembly upwardly about said axis; and (G) said power and control means further includes means operative in response to a predetermined amount of upward pivotal movement of said magnet assembly relative to said carriage to move said carriage and thereby said magnet assembly rearwardly along said guideway to a rest position of said carriage and magnet assembly in which said magnet is totally withdrawn from the stack side face.

4. A magnet assembly according to claim 3 wherein:

(H) said power and control means are further operative following movement of said carriage to its withdrawn, rest position to repeat the operative steps of 1 (E) (1) and 1 (E) (2) and thereby restore said carriage and magnet assembly to their operative relative position with said magnet leading face in engagement with the stack side face.

5. A magnet assembly according to claim 1 wherein:

(F) said magnet further includes a beveled surface extending downwardly and rearwardly away from the lower end of said magnet leading face so that misaligned sheets in the stack that project transversely from the side face of the stack by a distance less than the rearward extent of said beveled surface will engage said beveled surface as the stack is raised in response to stack depletion and cammingly move said magnet assembly rearwardly relative to said carriage against the bias of said lost motion spring by a distance corresponding to the transverse projection of the misaligned sheets; and (G) said power and control means are operative in response to cumulative camming rearward movement of said magnet assembly relative to said carriage to said initial relative position to again move said carriage rearwardly through said second predetermined distance to said operative relative position while said magnet leading face in maintained in engagement with the stack side face by said lost motion spring.

6. A magnet assembly according to claim 5 wherein:

(H) said magnet is also mounted for pivotal movement relative to said carriage about a horizontal axis spaced rearwardly from said magnet leading face and presents a generally horizontal undersurface extending rearwardly from the lower rearward end of said beveled surface so that as the stack is raised in response to stack depletion, any sheets transversely misaligned by an amount greater than the rearward extent of said beveled surface will engage said undersurface and pivot said magnet assembly upwardly about said axis; and (I) said power and control means further include means operative in response to a predetermined amount of upward pivotal movement of said magnet assembly relative to said carriage to move said carriage and thereby said magnet assembly rearwardly along said guideway to a rest position in which said magnet is totally withdrawn from the side face of the stack.

7. A magnet assembly according to claim 1 wherein:

(F) said carriage defines a lost motion guideway against adjacent its forward end;

(G) said magnet assembly further includes a block member mounted in said lost motion guideway for forward and rearward movement relative to said carriage;

(H) said lost motion spring extends between said carriage and the rearward end of said block member;

(I) said magnet assembly further includes a magnet support frame pivoted at its rearward end to said block member for movement about a generally horizontal axis; and (J) said magnet is carried on the forward end of said magnet support frame.

8. A magnet assembly according to claim 7 wherein:

(K) said magnet support frame includes a rearward bifurcated portion including horizontally spaced arm portions embracing opposite sides of said block member;

(L) said magnet support frame is pivoted to said block member by a pivot pin passing through said arm portions and said block member;

(M) said magnet support frame further includes a forward bifurcated portion including vertically spaced arm portions; and (N) said magnet is mounted vertically between said vertically spaced arm portions and is pivoted relative to said support frame about a generally vertical axis passing through said vertically spaced arm portions.

* * * * *